United States Patent [19]

Brösigke

[11] Patent Number: 4,506,791

[45] Date of Patent: Mar. 26, 1985

[54] SHIP'S DERRICK

[75] Inventor: Michael Brösigke, Hamburg, Fed. Rep. of Germany

[73] Assignee: Blohm & Voss AG, Hamburg, Fed. Rep. of Germany

[21] Appl. No.: 528,633

[22] Filed: Sep. 1, 1983

[30] Foreign Application Priority Data

Sep. 1, 1982 [DE] Fed. Rep. of Germany ..... 3232489

[51] Int. Cl.[3] ..... B66C 1/00

[52] U.S. Cl. ..... 212/190; 212/257; 212/262

[58] Field of Search ..... 212/182, 186, 175, 227, 212/228, 239, 255–258, 262, 190–194, 178

[56] References Cited

U.S. PATENT DOCUMENTS

| | | | |
|---|---|---|---|
| 85,279 | 12/1868 | Campbell | 212/227 |
| 234,313 | 11/1880 | McMyler | 212/227 |
| 850,757 | 4/1907 | Hutchins | 212/190 |
| 1,122,236 | 12/1914 | Schirmer | 212/193 |
| 1,368,157 | 2/1921 | Jardine | 212/257 |
| 2,809,756 | 10/1957 | Bannister | 212/186 |
| 3,318,463 | 5/1967 | Mattson et al. | 212/182 |

FOREIGN PATENT DOCUMENTS

| | | | |
|---|---|---|---|
| 622830 | 12/1935 | Fed. Rep. of Germany . | |
| 807981 | 7/1951 | Fed. Rep. of Germany | 212/256 |
| 1164055 | 2/1964 | Fed. Rep. of Germany | 212/257 |
| 1956215 | 1/1971 | Fed. Rep. of Germany . | |

*Primary Examiner*—Trygve M. Blix
*Assistant Examiner*—Stephen P. Avila
*Attorney, Agent, or Firm*—Nils H. Ljungman

[57] ABSTRACT

A ship's derrick can be swiveled and tripped up by means of a goose-neck pin-bearing and one or more topping lift tackles. Its tackle is fastened to a crab which can be moved in the longitudinal direction of the derrick by means of a tackle line. In the case of a heavy cargo derrick, the tackle line between the derrick brace and the crab comprises a multi-part tackle which may be cut and dimensioned similar to the load tackle and which is provided with two hauling parts, the arrangement being such that the topping lift tackles act on the crab.

5 Claims, 2 Drawing Figures

SHIP'S DERRICK

BACKGROUND OF THE INVENTION

1. Field of the Invention

This invention relates to an improved ship's derrick which can be swiveled and tripped up by means of a suitable bearing such as a goose-neck pin-bearing, and one or more topping lift tackles, and whose load tackle is attached to a crab which can be moved, by means of tackle lines, in the derrick's longitudinal direction.

2. Description of the Prior Art

It has been known to hold either the derrick's topping lift rope, together with the swiveling rope or guy rope, in a state of tension by means of the loading weight which is suspended from a crab which travels along the derrick (DE-PS 622 830), or, with horizontal derricks, in the case of a derrick with a height adjustable goose-pin bearing, a load should be shifted horizontally (DE-PS 19 56 215). In both cases, ropes are provided, the tension in which keeps the crab fixed in place or slides it in both directions along the boom.

In spite of these known types of derricks there remains a very real and substantial need for derricks which contribute to improved ship's stability.

SUMMARY OF THE INVENTION

The present invention has met the above-described need by resisting the tendency of the stability of the ship to be reduced by the tripping up of a loaded derrick. Such tripping up tends to lift the point of application of the load in an undesirable fashion. In accordance with the present invention the problem is reduced by employing a system which moves the load's point of application down along the tripped up derrick.

In a preferred approach of the invention in a heavy cargo derrick, the tackle line between the derrick's boom and the crab comprises a multi-part tackle which is cut and dimensioned similar to the load tackle and which is provided with two hauling parts, the arrangement being such that the topping lift tackles act on the crab.

When tripping-up the derrick carrying a load with a large overhang, it is thus possible to lower the crab by means of a single tackle from the highest position to a lower position, and thus improve the stability. The process, on tripping the derrick, is correspondingly reversible. Furthermore, an additional bending moment in the derrick is prevented by the topping lift tackle acting on the crab.

In a further embodiment of the invention, in the displacement region of the crab, the heavy cargo derrick may preferably be made in the form of a rectangular tube or circular cross-section tube fitted with external slide rails to facilitate controlled movement of the crab relative to the tube.

It is an object of the present invention to provide an improved ship's derrick which resists adverse effects on ship's stability caused by the derrick.

It is another object of the invention to provide such a derrick which is adapted to move the load's point of application downwardly along a tripped up derrick.

It is a further object of the invention to provide such a derrick which is economical to adopt and employ.

These and other objects of the invention will be more fully understood from the following description of the invention on reference to the illustrations appended hereto.

DESCRIPTION OF THE PREFERRED EMBODIMENTS

Figure 1:
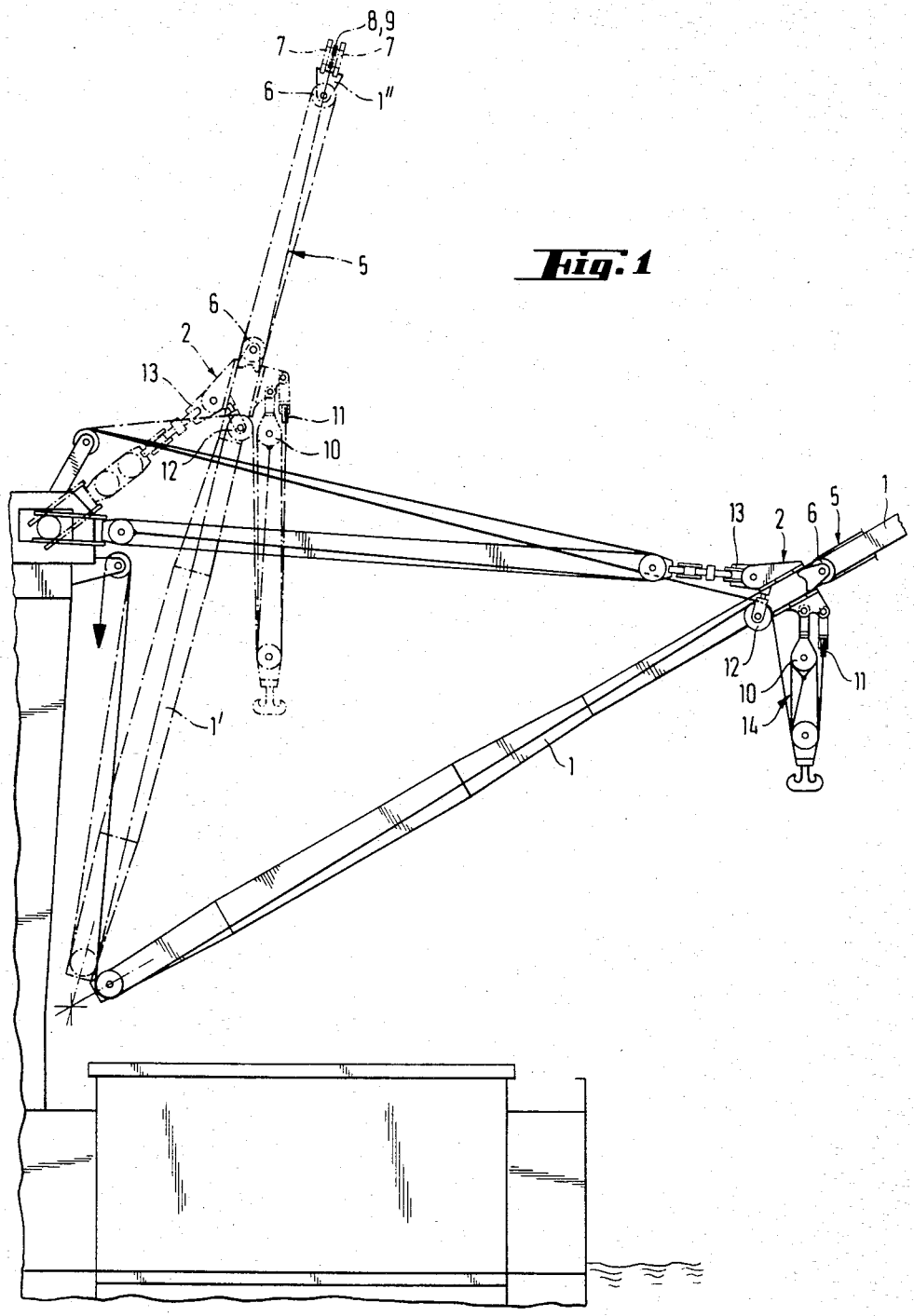
FIG. 1 is a schematic drawing of the invention with a displaceable crab with maximum length of boom or with maximum tripping-up of the derrick shown and FIG. 2 presents a perspective drawing of a top portion of the derrick shown in FIG. 1.

The derrick 1, on which is mounted the sliding crab 2, is made, in the sliding-region of crab 2, in the form of a generally rectangular tube or circular-section tube with attached slide-rails 3 in order to prevent the crab 2 from rotating around the longitudinal axis of the tube 1 should the ship list or should there be different topping lift forces. Located between the crab 2 and the slide-rails 3 are sliding contacts 4 which reduce the friction therebetween. Sliding of the crab 2 is effected by means of two connected tackles 5 which are preferably cut and dimensioned generally similar to the load tackle located on either side of the derrick 1. The arrangement is such that the rope sheaves 6 belonging to each tackle have a first group attached to the crab 2 and, a second group attached to the derrick's head-fitting 7 which is secured to tube 1. Equalization of the two tackle lines 5 is effected by means of the outer rope sheaves 8. The tackle lines 5 may preferably be rope or cable. The hauling portions of the tackle lines 5, coming from the crab 2, are taken over two rope sheaves 9 mounted in the head fittings 7, and from there, over two additional deflecting sheaves, which are mounted either on the crab 2 or on the lower end of the derrick 1, to the masts, the stanchions or similar fixed points, and from there to a suitable winch.

Figure 2:
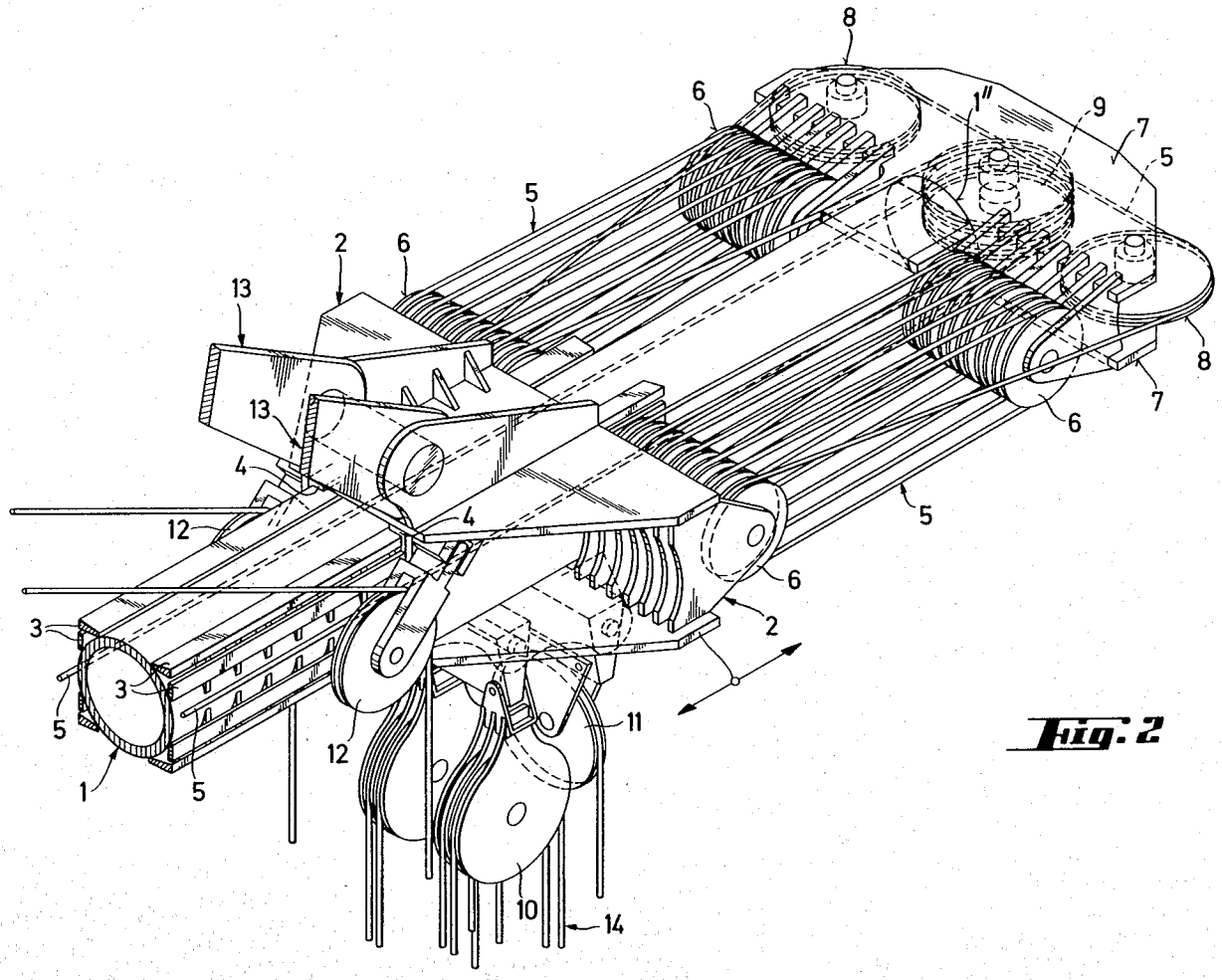

The load tackle 14 comprises, in known manner, the lower load block (not shown in FIG. 2), the upper load block 10, the compensating sheaves 11 and the deflection sheaves 12. The hauling part is passed over the deflection sheaves 12 to the mast, the stay posts (stanchions) or analogous fixed points and from there to the winch. The topping lift fittings, that is, the topping lift tackle's point of attachment, is denoted by the reference number 13 and is located on the top side of the crab 2.

Whereas particular embodiments of the invention have been described above for purposes of illustration it will be appreciated by those skilled in the art that numerous variations of the details may be made without departing from the invention as described in the appended claims.

We claim:

1. A ship's derrick which can be swiveled and tripped up by means of a bearing and one or more topping lift tackles and whose loading tackle is directly attached to a crab which can be moved in the derrick's longitudinal direction by means of a tackle line, characterized in that in a heavy cargo derrick, the tackle line between a tubular portion of the derrick brace and the crab comprises a multi-part tackle which is dimensioned generally similar to the load tackle and which is provided with two hauling parts, the arrangement being such that the topping lift tackles act on the crab, a derrick head fitting secured to said tube in spaced relationship with respect to said crab, a first series o sheaves rotatably secured to said crab, a second series of sheaves rotatably secured to said derrick head fitting, said tackle lines being in supported contacting relationship with respect to said sheaves, and said first series of sheaves and said second series of sheaves each having sheaves disposed on both sides of said tube.

2. The ship's derrick of claim 1 wherein the derrick is constructed in the sliding region of either the crab as a generally rectangular or a generally circular section tube having slide-rails.

3. The ship's derrick of claim 2 wherein friction reducing means are interposed between said crab and said slide-rails.

4. The ship's derrick of claim 3 including a first hauling part of said tackle line operatively associated with the first and second said sheaves on one side of said tube, and a second hauling part of said tackle line operatively associated with the first and second said sheaves on the other side of said tube.

5. The ship's derrick of claim 4 including said topping lift tackle is disposed in underlying supported relationship with respect to said crab, whereby movement of said crab with respect to said tube will result in responsive movement of said topping lift tackle.

* * * * *